US005340335A

United States Patent [19]

Haun

[11] Patent Number: 5,340,335

[45] Date of Patent: Aug. 23, 1994

[54] ELECTRICAL TAP CONNECTOR

[75] Inventor: Christopher Haun, Willowdale, Canada

[73] Assignee: The Whitaker Corporation, Wilmington, Del.

[21] Appl. No.: 38,726

[22] Filed: Mar. 26, 1993

[51] Int. Cl.[5] ..... H01R 4/50

[52] U.S. Cl. ..... 439/783; 403/374

[58] Field of Search ..... 439/783, 803, 863; 174/90, 94 R, 94.5; 403/314, 374; 24/136 R, 136 B

[56] References Cited

U.S. PATENT DOCUMENTS

| | | | |
|---|---|---|---|
| 4,027,939 | 6/1977 | White | 439/783 |
| 4,114,977 | 9/1978 | Polidori | 403/390 |
| 4,600,264 | 7/1986 | Counsel | 439/783 |
| 5,092,797 | 3/1992 | Cole et al. | 439/783 |
| 5,145,420 | 9/1992 | Counsel et al. | 439/783 |

FOREIGN PATENT DOCUMENTS

| | | | |
|---|---|---|---|
| 147265 | 1/1950 | Australia | 24/136 R |

*Primary Examiner*—Neil Abrams
*Attorney, Agent, or Firm*—Katherine A. Nelson

[57] ABSTRACT

An improved electrical tap connector 20 of the type having a C-shaped body member 22 having laterally opposing arcuate ears 26 extending laterally therealong and converging from a wide end to a narrow end, the body member 22 being adapted to receive a wedge member 40 having opposed converging side surfaces concave therealong defining wire-receiving channels 28 in cooperation with corresponding ones of the arcuate ears 26 opposed therefrom, a drive bolt causing the wedge member 40 to be driven into the wide end of the C-shaped body 22 and held therein, and a stabilizing member 34 at least affixed to one of the C-shaped and the wedge members 22, 40, the stabilizing member 34 being operable during movement of the wedge member 40 into a final connected position in the C-shaped member 22 to locate at least the front end 44 of the wedge member 40 substantially centrally between the arcuate ears 26 of the C-shaped member 22. The stabilizing member 34 in cooperation with an axial channel 48 on the other of the C-shaped and wedge members prevents axial movement and relative lateral movement of the front end of the wedge member 40 with resect to the C-shaped member 22.

9 Claims, 8 Drawing Sheets

ELECTRICAL TAP CONNECTOR

FIELD OF THE INVENTION

This invention relates to the field of electrical connectors, and, more particularly, to connectors for electrically and mechanically connecting a pair of uninsulated wire conductors.

BACKGROUND OF THE INVENTION

Electrical connectors that interconnect a pair of uninsulated wire conductors are known. The connectors include a conductive insert that is wedged into a C-shaped member, compressing the wires between ear-like sections of the C-shaped member and opposing concave surfaces of the sides of the wedge. Typically, the connector uses an installation or drive bolt to force the wedge-shaped member into the C-shaped member until the wires are sufficiently compressed there between. The examples of connectors of this type are found in U.S. Pat. Nos. 4,600,264 and 5,092,797. One such product is sold by AMP of Canada Ltd., Markham, Ontario, Canada under the trademark "AMP WRENCH-LOK Connector".

In the devices disclosed above, the separate wedge is engaged with a captive insertion bolt or drive screw. The captive nature is provided by a lateral slotted lug. The screw and lug are latterly shiftable with respect to one another to allow the wedge to be free-floating. The screw is captive longitudinally and can be driven in either direction to drive the wedge forward or in the reverse direction. Because the wedge is "free-floating", it can often interfere with the initial attachment of the connector to the conductors.

Connectors of the above type are typically used for interconnecting a tap cable or conductor to a run cable or conductor. The interconnection may be done while the run cable is carrying a high-potential voltage, known in the art as a "live" or "hot" cable or alternatively when the run cable is "dead". Since these connectors are often used in hot situations, the C-shaped body member includes a "hot" stick tab for holding the member with an insulated tool until interconnection has been completed. Because many of the connections are made to overhead hot electrical cables, manipulation of the connector to engage the wires between the C-shaped member and the wedge and to position the wedge for insertion into the body is awkward at best and sometimes is very difficult and time-consuming.

It is desirable, therefor, to provide a means for stabilizing and centering the leading end of the wedge in the C-shaped body during the initial installation process so that the connector can be mounted to the conductors without interference from the leading end of the wedge. Then as the wedge is then moved into the C-shaped body to complete the installation, the locking means or stabilization feature is released to allow the wedge to be free-floating and accommodate any differences in diameter of the conductors.

SUMMARY OF THE INVENTION

The present invention is an improved tap connector of the type having a C-shaped body member having opposing arcuate ears extending laterally therealong and converging from a wide end to a narrow end, a wedge member having opposed converging side surfaces concave therealong defining wire-receiving channels in cooperation with corresponding ones of the arcuate ears opposed therefrom and a drive bolt for causing the wedge member to be driven into the wide end of the C-shaped body and held therein. The improved connector further includes a stabilizing member affixed to at least one of the C-shaped and wedge members, the stabilizing member operable during movement of the wedge member into a final connected position in the C-shaped member to locate at least the front end of the wedge member substantially centrally between the arcuate ear members of the C-shaped member. The stabilizing member has a first section at least engaging one of the C-shaped member and wedge member in a manner preventing axial movement with respect to the one, and a second section extending toward a surface of the other of two members and movably held within a channel extending axially along a center of the surface of the other member. The second section is thereby constrained laterally by side walls of the channel disallowing relative lateral movement of the front wedge end with respect to said C-shaped member.

In one embodiment the stabilizing member is a wedge engaging tab or protrusion having a first section attached to the C-shaped body and extending into the wedge receiving opening of the body and a second section engagable in a complementary channel in the wedge to hold the wedge centered within the body when the wedge is at its most extended position. The invention further provides that the protruding tab member be released from the channel as the wedge is moved into the C-shaped member and into compression engagement with the conductors secured between the ears of the C-shaped member and the wedge. The release of the wedge allows the orientation of the wedge to be adjusted during application and to accommodate varying diameters of the conductors being interconnected.

In an alternative embodiment, the stabilizing member is a clip member having an arcuate first section which abuts a surface of the C-shaped member at the wide end thereof and outwardly extending flanges defining a second section. The free ends of the second section are spring biased in undercut side walls of a channel extending rearwardly from a forward end of the wedge member thereby securing the clip to the wedge member and permitting movement along the channel. The clip holds the forward end of the wedge member in a selected lateral position prior to mounting the connector to the conductors and driving the wedge member into the C-shaped body member.

Representative embodiments of the present invention will now be described by way of example with reference to the accompanying drawings.

BRIEF DESCRIPTION OF THE DRAWINGS

FIG. 8 is an exploded view of the connector of the present invention.

FIG. 9 shows the assembly with the wedge anchored into position ready for installation on to cables.

FIG. 10 shows the wedge partially inserted and the anchoring member being released from the complementary channel of the wedge.

FIG. 11 shows the wedge in its "free-floating" position as it adjusts to the thicknesses of the cables.

FIG. 12 is a view of the connector assembly when the wedge has been fully inserted.

DETAILED DESCRIPTION OF THE DRAWINGS

Figure 1:
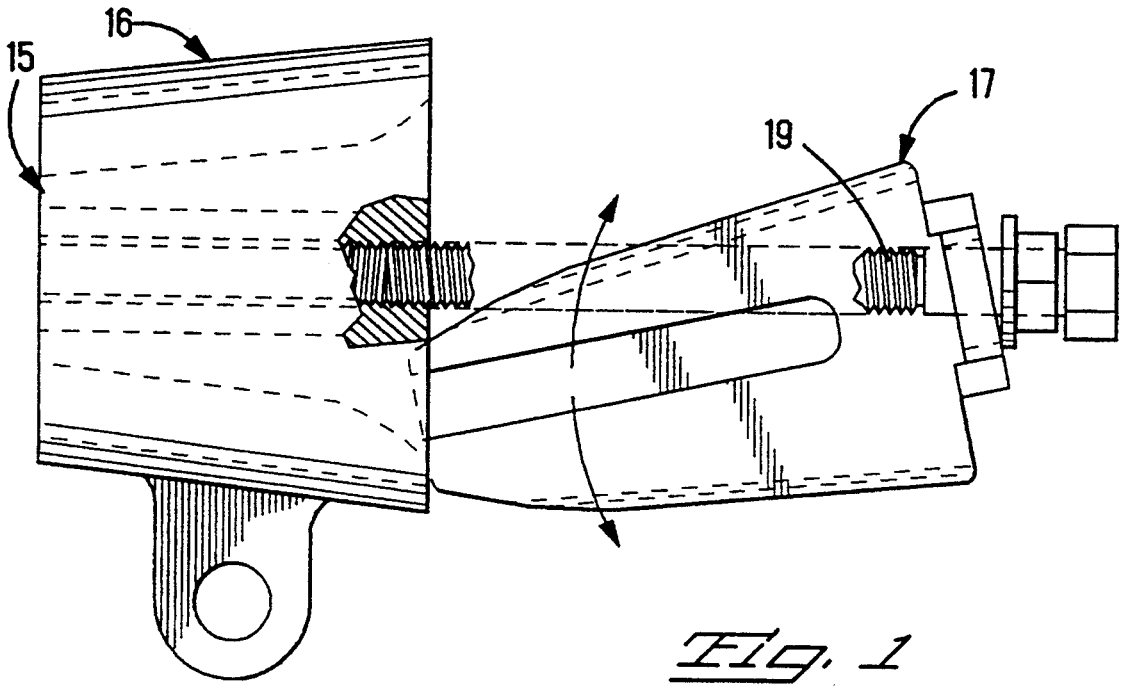
Fig. 1 PRIOR ART
FIG. 1 is a top view of a prior art connector with a portion of the C-shaped body cut away to illustrate the movability of the forward end of the wedge.

Referring now to FIGS. 3 through 7, the connector 20 of the present invention includes a C-shaped body member 22, a wedge member 40, and an installation or drive bolt 60 (shown in FIGS. 4 through 7) that are applied to uninsulated wires 70, 72 as shown in FIGS. 8 through 12, to interconnect the wires under substantial compression. C-shaped body member 22 includes a transverse section 24, extending laterally to opposed arcuate ears 26 defining wire grooves 28 that converge from one edge toward the other along a transverse section 24. An axial flange embossment 30 is disposed centrally of the transverse section 24, and includes a partially threaded aperture 32 extending the length of the C-shaped body member 22 into which bolt 60 will be threaded during application. Body member 22 further includes a stabilization member in the form of an inwardly directed wedge-engaging tab or protrusion 34 attached to the C-shaped member and extending into the wedge receiving opening. A second section of wedge-engaging tab 34 cooperates with a complementary portion of wedge member 40 to hold the wedge member 40 in alignment at the beginning of the installation as more fully described below. C-shaped body member 22 also includes "hot" stick tab 36 having aperture 38 extending therethrough for use with tools during installation of the connector to the conductors.

Wedge member 40 comprises preferably a solid body 41, shaped and dimensioned to be received into C-shaped body member 22 from the relatively opened end thereof and transverse flange 54. Body member 41 includes top surface 42, leading end 44 and converging concave side surfaces 46 therealong, that cooperate with opposing wire grooves 28 of C-shaped body 22 to define wire channels 28 for containing wires 70–72 therein, as illustrated in FIGS. 8 through 12. Transverse flange 54 extends outwardly from the wedge shaped body 41 at a wide end and includes a slot 56 therethrough, through which the shank of the drive bolt 60 will be inserted prior to being threaded into aperture 32 of C-shaped body 22. Slot 56 permits the orientation of the wedge member 40 to become adjusted during application to the cables 70, 72 thereby accommodating different sized conductors. Top surface 42 of wedge member 40 further includes a tab-receiving channel 48 extending from the leading end 44 to the transverse flange 54. Channel 48 includes forward portion 50, transition portion 51 and rearward portion 52. Forward portion 50 is configured to receive wedge-engaging tab or protrusion 34 such that the leading end 44 of the wedge is held centrally in the C-shaped opening, as illustrated in FIGS. 4 through 7. The rearward portion 52 of channel 48 is dimensioned to provide clearance for wedge-engaging protrusion 34 but to allow the wedge member 40 to move freely within the C-shaped member as the connector is installed on the conductors or cables 70–72. In the embodiment shown in FIGS. 3 through 12, wedge-engaging tab 34 and forward portion 50 of tab-receiving channel 48 have complementary dove-tail configurations. It is to be understood that the dove-tail shape is representative of various shapes that may be used to accomplish the desired purpose.

Figure 2:
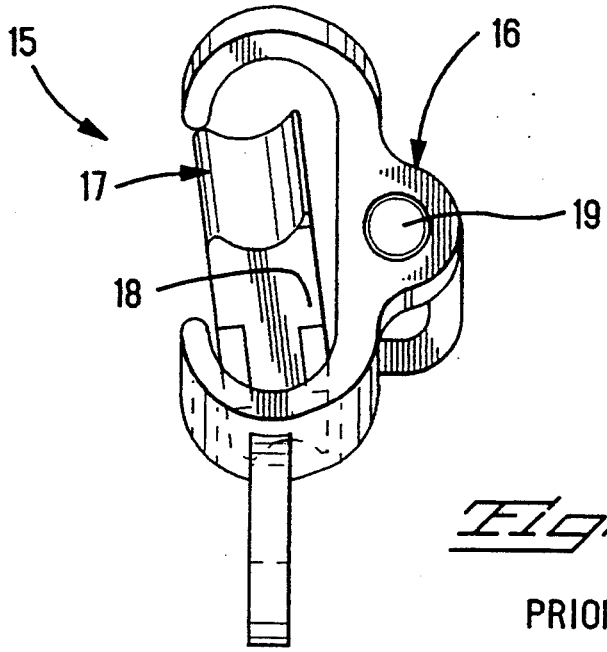
Fig. 2 PRIOR ART
FIG. 2 is an end view of the connector of FIG. 1 showing the wedge carried outwardly and lying against one of the ears of the C-shaped body member.
Figure 3:
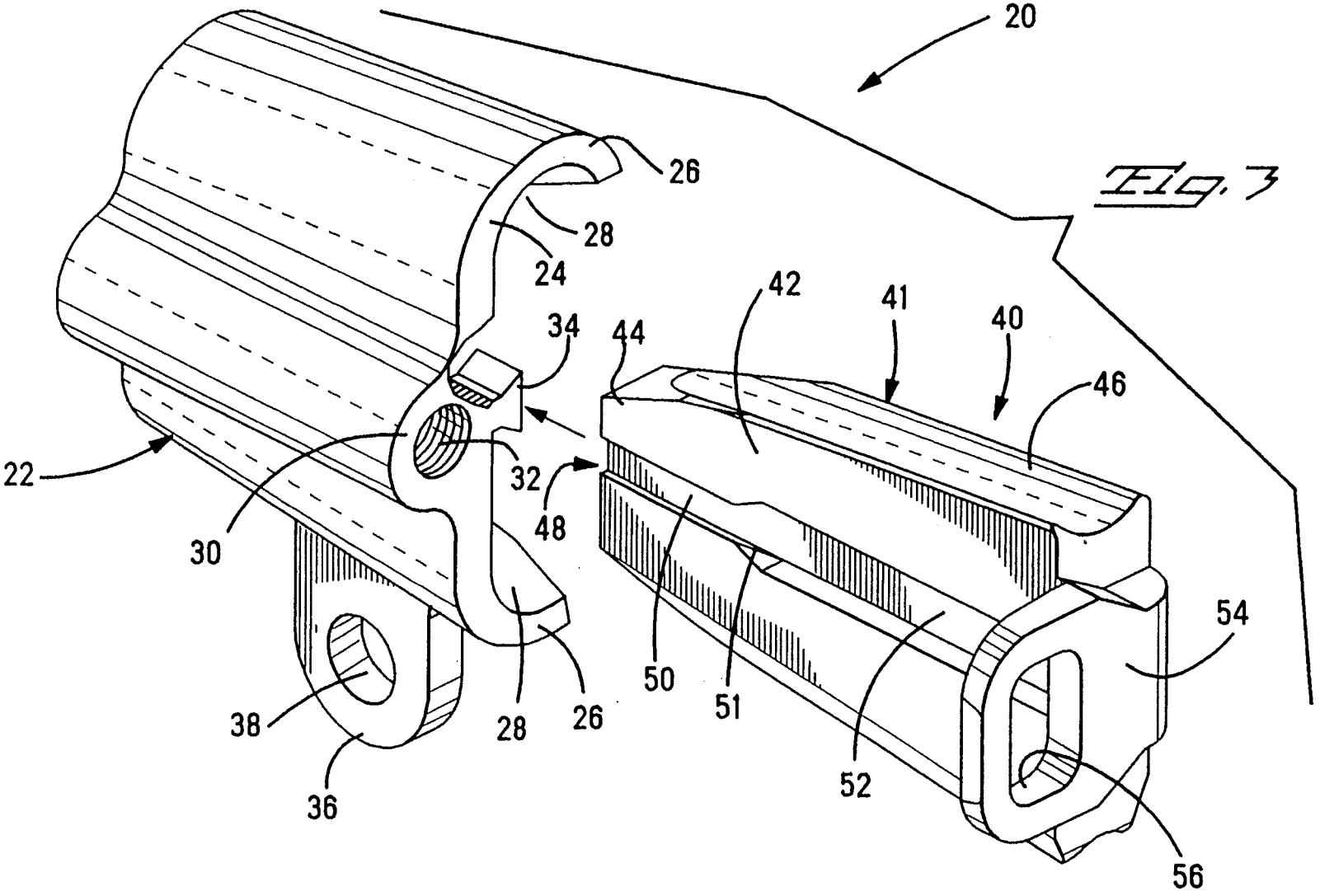
FIG. 3 is an exploded perspective view of the present invention.
Figure 4:
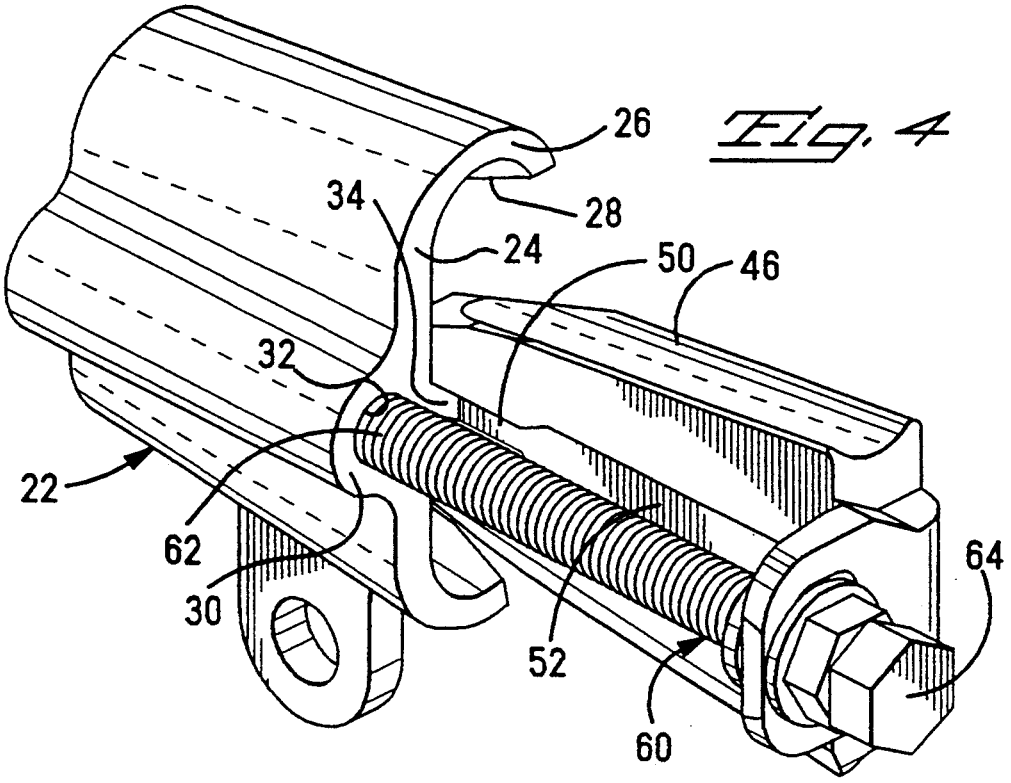
FIG. 4 is a perspective view of the assembled connector of FIG. 3 as it is ready for installation.
Figure 5:
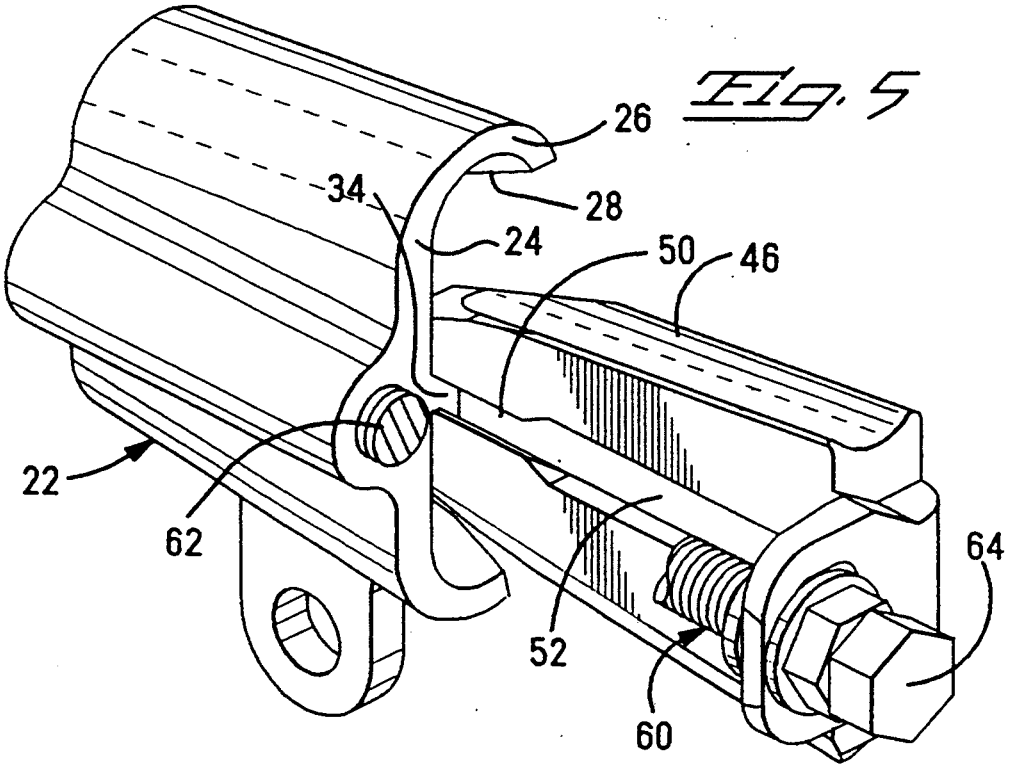
FIG. 5 is a view similar to FIG. 4 with the bolt cut away to illustrate the stabilization or locking feature of the present invention.
Figure 6:
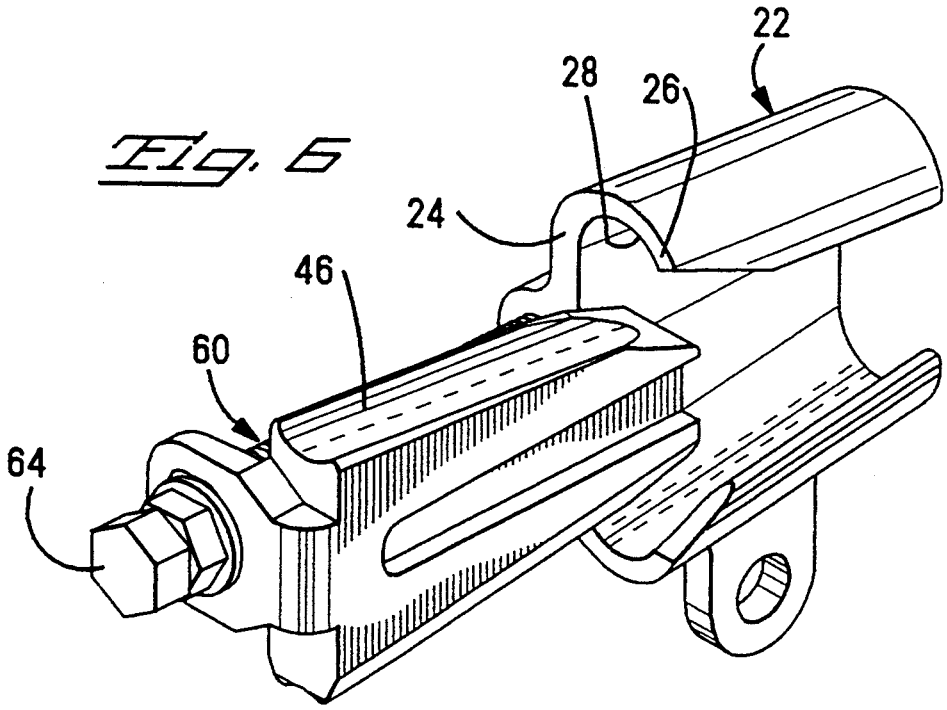
FIG. 6 is a perspective view of the connector of FIG. 3 from the opposite side showing the connector centered in the opening.
Figure 7:
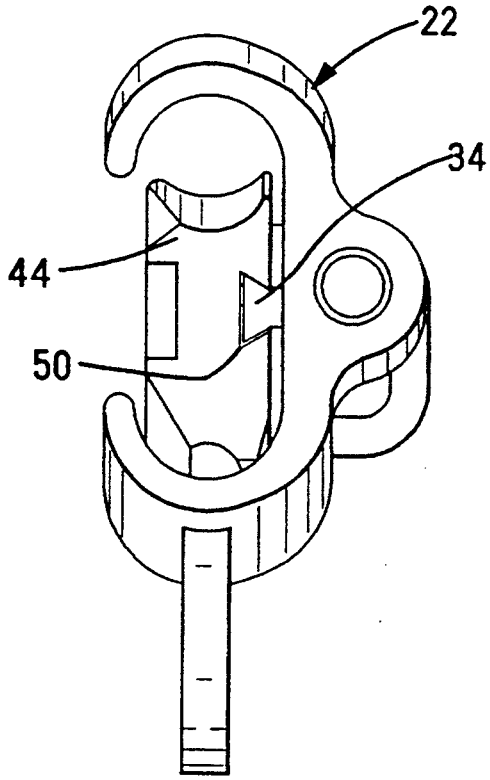
FIG. 7 is an end view of the assembly of FIG. 3.

The prior art connector 15, as shown in FIGS. 1 and 2, has no means for stabilizing the leading edge of the wedge in the C-shaped member. The C-shaped body member 16 lacks a wedge-engaging protrusion and wedge 17 lacks the complementary channel. The end of the wedge 17, therefore, can move freely about within the C-shaped opening. The leading edge of wedge 17 can stub against the edge of body 16 and can also cant outwardly, as shown in FIG. 2, thereby making installation difficult. In order to install the connector on the corresponding cables, the wedge must be moved by the installer from one side to the other in order for the connector to be attached to the second wire. In connector 20 of the invention, on the other hand, the wedge member 40, being held securely at its forward end, allows the installer to clamp on to the two wires with little or no interference from the wedge. Furthermore, wedge-engaging protrusion 34 holds wedge member 40 securely against the inner surface of the C-shaped body, which is particularly advantageous if, during installation, the opening of the C-shaped member is directed downwardly.

Figure 8:
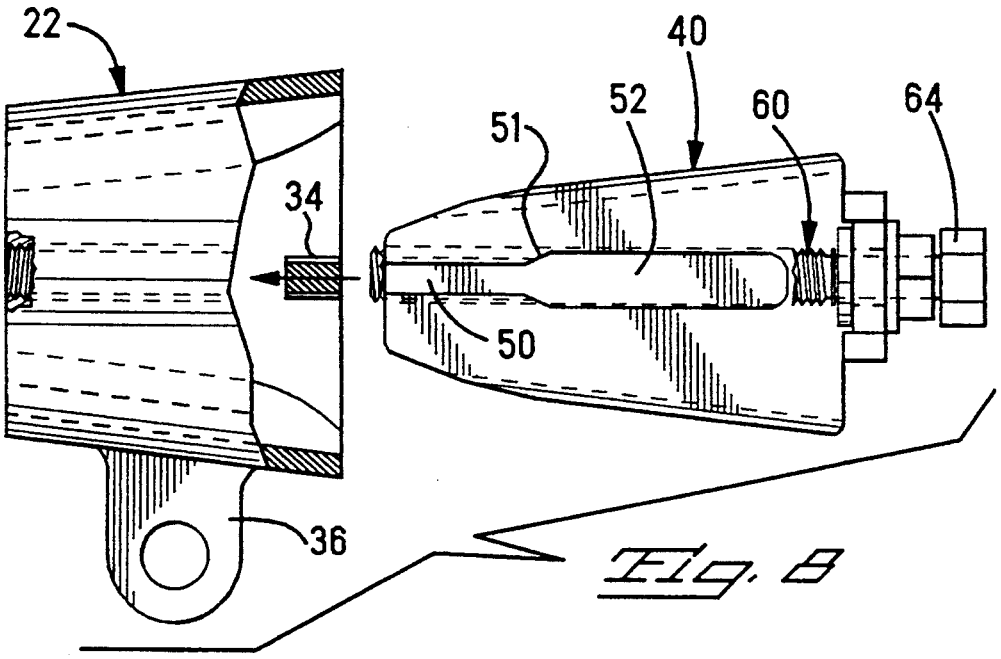
FIGS. 8 through 12 illustrate the interaction between the wedge and C-shaped member as the connector is installed. For purposes of illustration, the wires are shown in phantom and portions of the C-shaped member and wedge are cut away.
Figure 9:
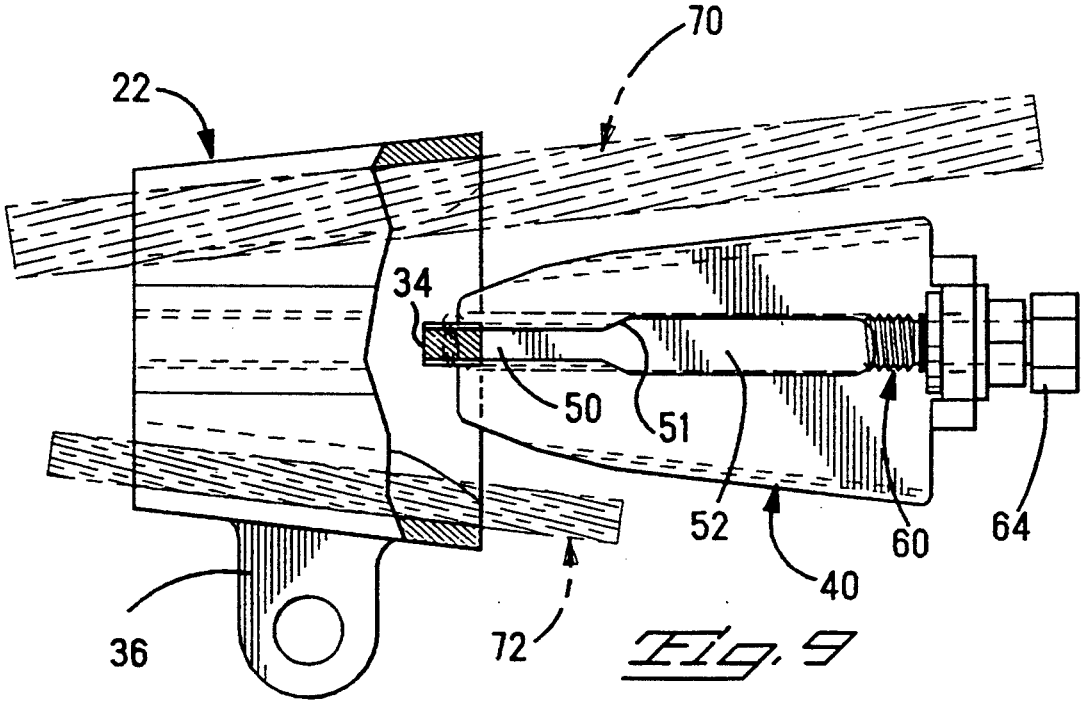
Figure 10:
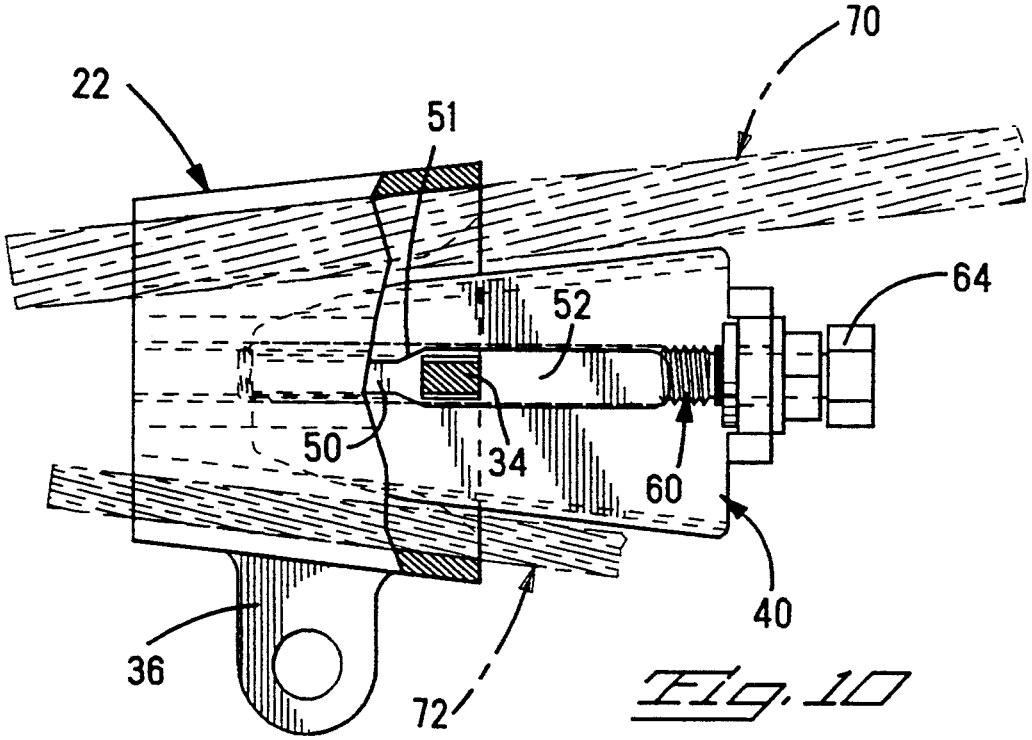
Figure 11:
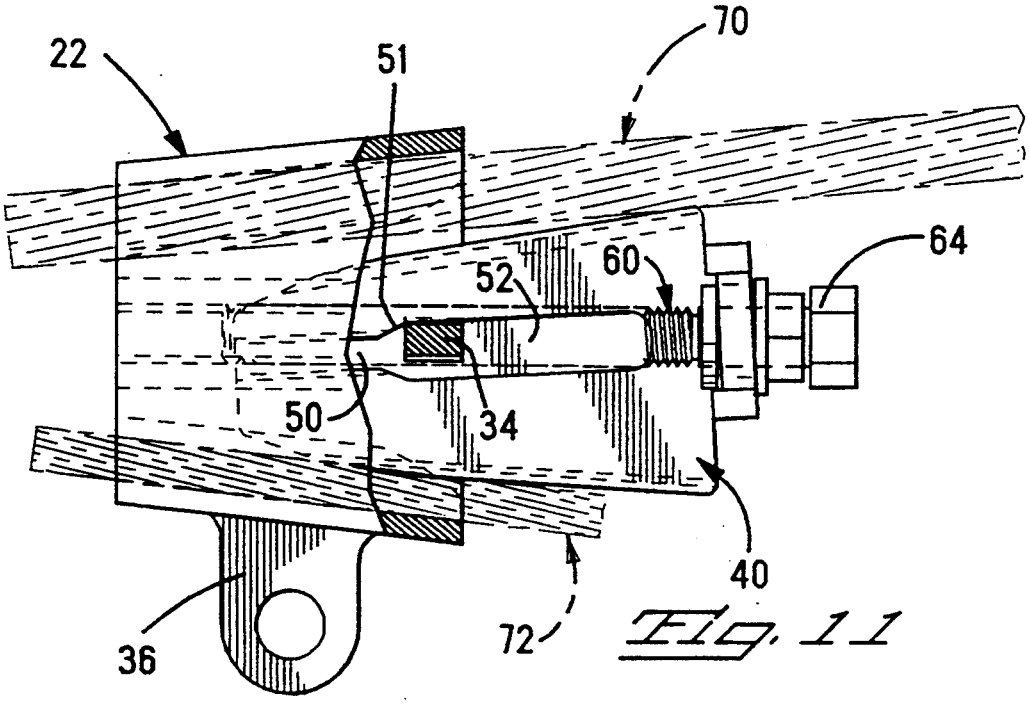
Figure 12:
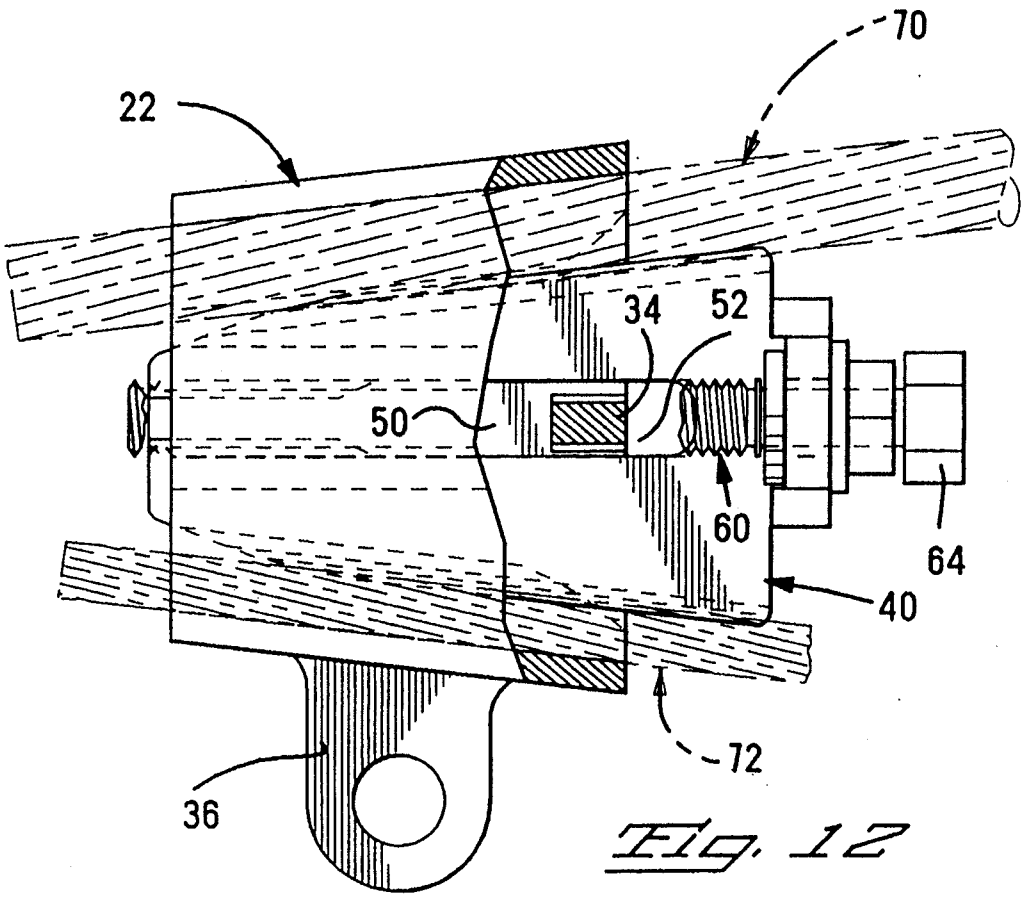

Referring now to FIGS. 8 through 12, which show a representative installation of connector 20 to two cables 70 and 72, fragmentary portions of which are shown in phantom. For purposes of illustration, portions of the C-shaped member 22 and bolt 60 have been cut away. FIG. 8 shows the wedge member 40 exploded from C-shaped member 22 and having the wedge-engaging tab 34 aligned to be received in forward channel portion 50 of wedge member 40. FIG. 9 shows wedge-engaging protrusion 34 received into forward channel portion 50 thereby centering and securing leading end 44 of wedge member 40 in C-shaped member 22. The connector assembly 20 is now ready for installation on the cable. FIG. 9 further illustrates connector 20 after it has been mounted to the two cables 70, 72. FIG. 10 shows the position of the wedge member 40 partially inserted into C-shaped member 22 and having wedge-engaging tab 34 passing through the transition zone 51 in tab-receiving channel 48. The sides of the transition zone 51 are preferably tapered to aid in aligning the wedge-engaging tab 34 in channel portion 50 when wedge member 40 is withdrawn from C-shaped member 22. FIG. 11 shows the movement of the wedge member 40 as bolt 60 further drives the wedge member 40 into the connector body 22 and that the wedge-engaging tab or protrusion 34 can move freely within the second channel portion 52, thereby allowing the wedge to "float freely" within the C-shaped connector and accommodate its position to the diameter or thicknesses of the wires being interconnected. FIG. 12 illustrates the connector in its fully assembled position.

By maintaining the leading end 44 of the wedge member 40 essentially centered within the C-shaped body member 22, and held relatively securely thereagainst, the wedge member 44 provides minimum interference and problems for the installer as the tap connector 20 is mounted to two wires. As the bolt 60 is tightened to move the wedge member 40 into the C-shaped body member 22 and into engagement with the conductors 70, 72 to complete the installation, the stabilization provided by the wedge-engaging tab 34 of the C-shaped member 22 and channel portion 50 of wedge member 40 continues until a sufficient portion of wedge member 40 has entered the C-shaped member 22 so that upon release, wedge member 40 will remain in proper alignment.

The present invention allows for easier installation, particularly in hot wire situations and with overhead wires since the installer has to use tools to manipulate the parts.

C-shaped body member 22 and wedge member 40 may be made for example by drawn or cast aluminum with commercially available inhibitor materials such as synthetic resin, having imbedded metal particles at least coating the wire-engaging surfaces to minimize corrosion, especially if a copper wire cable is to be interconnected. The bolt may also be made from aluminum such as alloy 2024.

Figure 13:
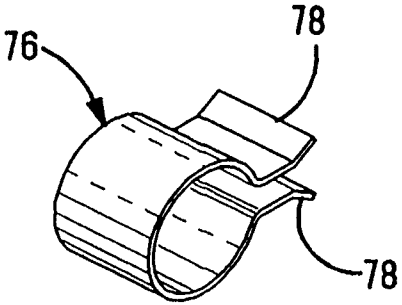
FIG. 13 shows a clip for use in an alternative embodiment of the present invention.
Figure 14:
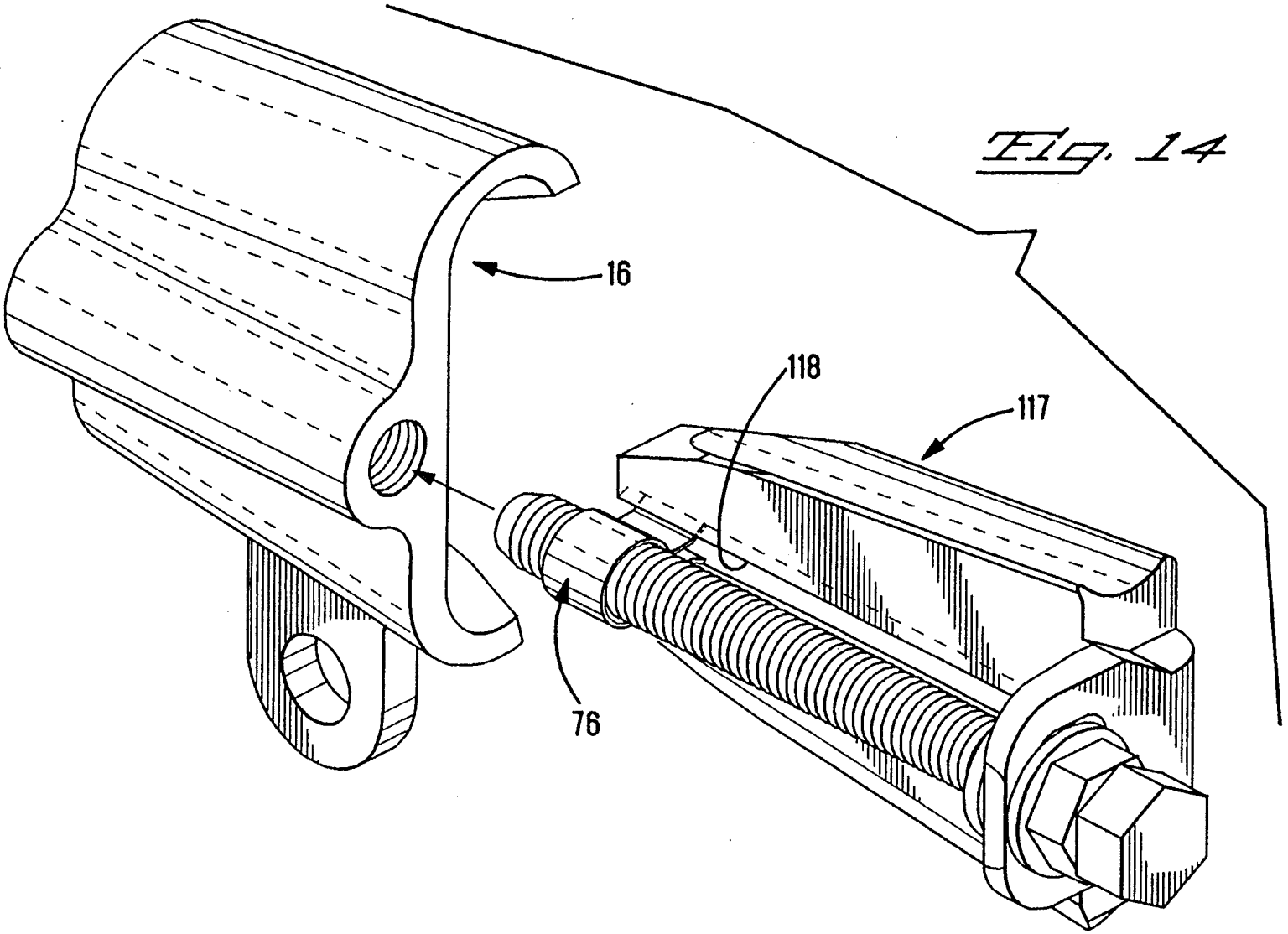
FIG. 14 is an exploded view of the alterative embodiment to the invention.

FIGS. 13 and 14 illustrate an alternative embodiment for a means of stabilizing the wedge member into position during the initial stage of installation of the connector onto wires. This embodiment uses the C-shaped member 16 of the prior art, a wedge member 117 having a profiled channel 118 extending along the top surface thereof, and a clip 76 that slidingly clamps around the drive bolt proximate the C-shaped member and holds the wedge 117 against the C-shaped member. Clip member 76 has an arcuate first section which abuts a surface of the C-shaped member 16 at the wide end thereof and outwardly extending flanges 78 defining a second section. The free ends of the second section are spring biased in undercut side walls of a channel extending rearwardly from a forward end of the wedge member thereby securing clip 76 to the wedge member 117 and permitting movement along the channel 118. The clip 76 holds the forward end of the wedge member in a selected lateral position prior to mounting the connector to the conductors and driving the wedge member into the C-shaped body member. The clip may be made from sheet metal, plastic or other material having sufficient spring characteristics to hold clip flanges 78 in groove 118 while permitting the clip to slide over the bolt as the wedge 117 is driven into position.

It is thought that the improved tap connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An improved electrical wire connector of the type having a C-shaped body member having laterally opposing arcuate ears extending laterally therealong and converging from a wide end to a narrow end, said wide end of said body member being adapted to receive a wedge member having opposed converging side surfaces concave therealong defining wire-receiving channels in cooperation with corresponding ones of said arcuate ears opposed therefrom, all for receipt thereinto of respective uninsulated wire conductors therealong to be interconnected upon compression between said wedge member and said C-shaped member by actuation of a drive bolt causing said wedge member to be driven in an axial direction into the wide end of said C-shaped body from a first preassembled position to a second final connected position and held therein, where said drive bolt is of the type having a threaded shank threadedly engageable with said C-shaped body member and at least an outer head adapted to be rotated by a tool whereby the bolt is adapted to be engaged by a work end of a tool having an appropriate configuration for rotation of the bolt, the improvement comprising:

a stabilizing member at least affixed to one of said C-shaped member and said wedge member, said stabilizing member operable during movement of said wedge member into said final connected position in said C-shaped member to locate at least said front end of said wedge member substantially centrally between said arcuate ears of said C-shaped member, said stabilizing member having a first section at least engaging one of said C-shaped member and said wedge member in a manner preventing axial movement with respect to said one, and said stabilizing member having a second section extending toward a surface of the other of said C-shaped member and said wedge member and movably held within a channel having undercut surfaces and extending axially along a center of said surface of said other, said stabilizing member being shaped and adapted to cooperate with said undercut surfaces, said wedge thereby being constrained by side walls of said channel disallowing relative movement orthogonally with respect to the axial direction of said front end of said wedge member with respect to said C-shaped member, whereby remotely actuated movement of said wedge member from said first position to said second position is stabilized.

2. The connector of claim 1 wherein said stabilizing member comprises a wedge-engaging tab having a first section affixed to said C-shaped body member at the wide end thereof, a second section of said tab extending from said first section and configured to be slidingly received in a complementary channel extending rearwardly from a forward end of said wedge member, said channel being adapted to slidingly receive said tab second section therein and therealong, said tab second section within said channel thereby holding said forward end of said wedge in a selected lateral position prior to mounting said connector to said conductors and driving said wedge into said C-shaped body member.

3. The connector of claim 1 wherein said stabilizing member comprises a clip member having an arcuate first section which abuts a surface of said C-shaped member at the wide end thereof and outwardly extending flanges defining a second section, free ends of said second section are spring biased in undercut side walls of a channel extending rearwardly from a forward end of said wedge member thereby securing said clip to said wedge member and permitting movement along the channel thereof and holding said forward end of said wedge in a selected lateral position prior to mounting said connector to said conductors and driving said wedge into said C-shaped body member.

4. The connector of claim 3 wherein said first clip section surrounds a remote section of said bolt and said bolt cooperates with said first clip section to assure said first section remains abutted against the rear surface of said C-shaped member.

5. The improved electrical wire connector of claim 1 wherein said channel on said other of said C-shaped member and said wedge member has first and second sections, said first section being configured to restrain said orthogonal movement of the front end of said wedge when the connector is in its preassembled position and said second section being configured to allow said wedge to move laterally to accommodate the differences in sizes of wire conductors receive in said connector as said connector is moved into its second position.

6. The improved electrical wire connector of claim 2 wherein said channel on said wedge member has first and second sections, said first section being configured to surround at least a leading end of said second section of said tab to restrain said orthogonal movement of the front end of said wedge when the connector is in its preassembled position and said second section being configured to allow said wedge to move laterally to accommodate the differences in sizes of wire conductors receive in said connector as said connector is moved into its second position.

7. A method of forming at termination between a pair of uninsulated conductors by assembling together a C-shaped member defining a wedge receiving region between opposing arcuate ears, and a wedge member pressed into said wedge-receiving region upon actuation of a drive bolt causing the wedge member to be driven into the C-shaped member until the conductors are compressed between concave side surfaces of the wedge and said arcuate ears of the C-shaped member comprising the steps of:

providing a stabilizing member on one of said C-shaped member and said wedge member, said stabilizing member operable during movement of said wedge member from a preassembled position into a final connected position in said C-shaped member to locate at least said front end of said wedge member substantially centrally between said arcuate ear members of said C-shaped member, said stabilizing member having a first section at least engaging one of said C-shaped member and said wedge member in a manner preventing axial movement with respect to said one, and said stabilizing member having a second section extending toward a surface of the other of said C-shaped member and said wedge member, said second section being shaped and adapted to be received in an undercut channel in the other of said C-shaped member and wedge member;

providing the other of said members with said undercut channel extending axially along a center of said surface of said other and adapted to receive said second section of said stabilizing member therein;

engaging said stabilizing member provided on one of said members into position with respect to said other member, such that said second section is received in said undercut channel;

initially threading an end portion of the bolt into the bolt receiving aperture of said C-shaped member, defining said preassembled position;

mounting said connector to two conductors such that said conductors are disposed along respective ones of the arcuate ears of the C-shaped member;

actuating movement of said wedge member in an axial direction into said C-shaped member by threading said bolt into said aperture until the conductors are compressed within conductor-receiving channels defined by and between the concave side surfaces of the wedge member and the arcuate ears of the C-shaped member defining said final position.

8. An improved electrical wire connector of the type having a C-shaped body member having laterally opposing arcuate ears extending laterally therealong and converging from a wide end to a narrow end, said wide end of said body member being adapted to receive a wedge member having opposed converging side surfaces concave therealong defining wire-receiving channels in cooperation with corresponding ones of said arcuate ears opposed therefrom, all for receipt thereinto of respective uninsulated wire conductors therealong to be interconnected upon compression between said wedge member and said C-shaped member by actuation of a drive bolt causing said wedge member to be driven in an axial direction into the wide end of said C-shaped body from a first preassembled position to a second final position and held therein, where said drive bolt is of the type having a threaded shank threadedly engageable with said C-shaped body member and at least an outer head adapted to be rotated by a tool whereby the bolt is adapted to be engaged by a work end of a tool having an appropriate configuration for rotation of the bolt, the improvement comprising:

a wedge-engaging tab extending from said C-shaped body member at the wide end thereof, said tab being configured to be slidingly received and slidingly secured in a complimentary channel at a forward end of said wedge member, said channel having undercut surfaces and said tab being shaped and adapted to cooperate with said undercut surfaces, said channel being adapted to slidingly hold said forward end of said wedge in a selected position prior to mounting said connector to said conductors and driving said wedge into said C-shaped body member whereby remotely actuated movement of said wedge member from said first position to said second position is stabilized.

9. The improved electrical wire connector of claim 8 wherein said channel on said other of said C-shaped member and said wedge member has first and second sections, said first section being configured to restrain said orthogonal movement of the front end of said wedge when the connector is in its preassembled position and said second section being configured to allow said wedge to move laterally to accommodate the differences in sizes of wire conductors receive in said connector as said connector is moved into its second position.

* * * * *